US005820633A

United States Patent [19]

Lesko et al.

[11] Patent Number: 5,820,633

[45] Date of Patent: Oct. 13, 1998

[54] METHOD OF TREATING LEATHER WITH IMPROVED RETAINING AGENTS

[76] Inventors: Patricia Marie Lesko, 191 Red Hill Rd., Ottsville, Pa. 18942; James John Hodder, 1133 Ferry Rd., Doylestown, Pa. 18901; Alvin Michael Maurice, 1505 Berkley Way, Lansdale, Pa. 19446

[21] Appl. No.: 895,259

[22] Filed: Jul. 16, 1997

Related U.S. Application Data

[60] Provisional application No. 60/026,414 Sep. 20, 1996.

[51] Int. Cl.[6] ..... C14C 3/22

[52] U.S. Cl. ..... 8/94.21; 98/94.33; 98/94.2; 98/94.23; 98/436

[58] Field of Search ..... 8/94.21, 94.33, 8/94.18, 436, 94.2, 94.23

[56] References Cited

U.S. PATENT DOCUMENTS

| | | | |
|---|---|---|---|
| 3,646,099 | 2/1972 | Dannals | 558/437 |
| 3,744,969 | 7/1973 | Alps et al. . | |
| 3,989,661 | 11/1976 | Bondy . | |
| 4,134,872 | 1/1979 | Lee . | |
| 4,439,201 | 3/1984 | Lauton et al. | 8/94.33 |
| 4,596,581 | 6/1986 | Höhr et al. . | |
| 4,631,063 | 12/1986 | Stockhausen et al. . | |
| 4,813,968 | 3/1989 | Kaussen et al. . | |

FOREIGN PATENT DOCUMENTS

| | | |
|---|---|---|
| 0372746 A2 | 6/1990 | European Pat. Off. . |
| 0498634 A2 | 8/1992 | European Pat. Off. . |
| 0646651 A2 | 4/1995 | European Pat. Off. . |
| 44 16 877A1 | 11/1995 | Germany . |
| 4-089900A | 3/1992 | Japan . |
| 1520068 A1 | 11/1989 | U.S.S.R. . |

OTHER PUBLICATIONS

*Handbook of Size Exclusion Chromatography*, Ed. Chi–san Wu, Marcel Dekker, Inc., 1995, Chapter I. (Month Unknown).

Lehninger, Albert L., *Biochemistry*, Chapter 7, p. 133, 1970. (Month Unknown).

Retannage with Polymer Tanning Agents, *The Leather Manufacturer*, pp., 9–26, 1990 (Month Unknown).

*Primary Examiner*—Alan Diamond
*Attorney, Agent, or Firm*—Wendy Choi

[57] ABSTRACT

The present invention is directed to a method of treating tanned leather to improve its dyeing characteristics while still retaining desired grain break and grain strength. The tanned leather is contacted, preferably by immersion, in a float containing a syntan and a desired colorant. The syntan includes a copolymer of a carboxylic acid monomer and a vinyl ester monomer, such as, vinyl acetate. The retanning method of the present invention provides wide process latitude.

17 Claims, No Drawings

METHOD OF TREATING LEATHER WITH IMPROVED RETAINING AGENTS

This application claims the benefit of provisional application Ser. No. 60/026,414 filed Sep. 20, 1996.

The present invention is directed to treating leather and more particularly to a method for retanning leather to improve its dyeing characteristics, which refers to the degree of uniformity of hue and intensity of color of the leather provided by the colorant used during the coloring of leather.

The treatment of hides and skins for producing leather involves a number of interdependent chemical and mechanical operations. These operations may be divided into a sequence of wet end steps, i.e., process steps under wet conditions, followed by a sequence of process steps under dry conditions. A typical leather making process involves the following sequence of wet-end steps: trimming and sorting, soaking, fleshing, unhairing, baiting, pickling, tanning, wringing, splitting and shaving, retanning, coloring, fatliquoring and setting out. These wet-end steps are followed by a sequence of dry steps, such as, drying, conditioning, staking, buffing, finishing, plating, measuring and grading. A description of each of these operations is provided in Leather Facts, New England Tanners (1972).

The present invention is involved with the wet-end steps that take place after primary tanning; namely retanning and dyeing, and, if desired, fatliquoring. The object of primary tanning is to convert the hide, pelt or skin to a stable non-spoilable material. This is accomplished by converting raw collagen fibers in the hide or skin into a stable product which is non-putrescible, or in other words will not rot. In addition, tanning improves a number of properties of the hide, pelt or skin, such as, for example, dimensional stability, abrasion resistance, resistance to chemicals and heat, improved flexibility and the ability to endure repeated cycles of wetting and drying. The principal method used to tan hides, pelts and skins is known as "chrome tanning", which involves treating the hide, pelt or skin with basic chromium sulfate, often referred to simply as "chrome". The chrome penetrates into the skin and imparts a bluish-green color to the skin. The color change is typically used to assess the extent of penetration or degree of tanning. Hides, pelts and skins may also be tanned using vegetable extracts, for example, extracts from trees and shrubs, such as, quebracho, wattle, sumac, hemlock, oak and spruce, and by a variety of the well known chemicals that react with collagen.

After primary tanning, the leather is generally retanned, colored and fatliquored. This three-step operation is often considered together as one step since all these three operations may be carried out sequentially in the same retanning drum in any desired order. Tanned leather stock retains much of the uneven fiber structure pattern in the skin on the animal. Some areas of the skin possess a dense structure while other portions are loosely fibered and some portions may be undesirably thin and papery. Since the tanner desires to produce a uniform piece of leather, a step, known as "retanning", is employed to improve both aesthetic and physical properties. These properties include, for example, improvements to the fullness of leather, the tightness and smoothness of leather grain, the break, better uniformity in temper or flexibility and additional stability against water and perspiration. The retanning step also influences the levelness and intensity of the dye shade. Additional information on each of these operations is available in Leather Technician's Handbook, J. H. Sharphouse, Leather Producers' Association (1983).

Retanning can be accomplished by using a variety of naturally derived materials including extracts from vegetables or plants, and synthetic tanning agents known as "syntans", or combinations thereof. Historically, extracts from trees and shrubs like quebracho, wattle, sumac, hemlock, oak and spruce were used as retanning agents. Over the past 50 years, many man-made syntans were developed and these are used extensively today. Naphthalene-formaldehyde and phenolic-formaldehyde syntans have been used as replacements for natural tannins and are strong dispersants for several other retanning chemicals. Cyanamide, dicyandiamide, urea, and melamine also react with formaldehyde to yield useful syntans. Acrylic syntans are polymers based on (meth)acrylic monomers that can be used as replacement or auxiliary syntans and sometimes as polymeric softeners depending on the composition of the polymer. In some instances the hide may be retanned with chromium sulfate to fully tan any previously untanned portions and to level out the chrome especially in the grain for more uniform dyeing. Before retanning, after retanning or, if desired, during retanning, the hide is colored with colorants, such as, acid dyes, mordant dyes, direct dyes, metalized dyes, soluble sulfur dyes, and cationic dyes. Colorants are classified both by chemistry and color. Colorants include natural pigments and synthetic dyes that are used to achieve the required color in both the cross section and the surface of crust leather before the finishing step. Leather during the wet-end process is typically treated with colorants alone or in combination with retanning agents. The anionic character of typical acrylic syntans leads to a more or less pronounced lightening of color when leather is dyed with conventional anionic dyes. This is undesirable.

Techniques directed to improving dyeing characteristics of the retanned leather have been tried before. Alps, et al in U.S. Pat. No. 3,744,969 (hereafter the '969 patent) describe the use of polyampholyte (or amphoteric) resins for improving dyeing characteristics with improved grain break and scuff resistance. The polyampholyte resins contain both acidic and basic groups pendent along a polymer backbone and are generally formed by free radical addition polymerization of a mixture of acid and base monomers. The aqueous solutions of polyampholyte resins suitable for use in the method disclosed in the '969 patent have an isoelectric point (hereafter IEP) in the pH range of 2.5 to 4.5. At pH values above the IEP, the polyampholyte resin is anionic in character, while at pH values below the IEP the polyampholyte resin is cationic in character. At pH values near the IEP, polyampholyte resins are neutral in charge and exhibit a sharp drop in solubility. When using polyampholyte resins, it is necessary to keep the pH high enough during the retannage to prevent a drop in solubility which can lead to problems such as a too superficial deposition of the retanning agent onto leather or poor penetration of other retanning agents and fatliquors into leather. Thus, it is seen that the treatment process of the '969 patent requires close process control and monitoring to avoid premature deposition of the polyampholyte resins. The method of the present invention solves this problem by utilizing a syntan that permits retanning of leather over a wider pH range while improving the dyeing of the retanned leather and still retaining other desired aesthetic and physical properties of the retanned leather.

The present invention is directed to a method of treating a tanned leather comprising:

retanning said tanned leather with a syntan to produce a retanned leather having improved dyeing characteristics, said syntan comprising:

(a) a copolymer polymerized by free-radical initiated polymerization from a monomer mixture comprising a carboxylic acid monomer and a vinyl ester monomer selected from the group consisting of vinyl acetate, vinyl propionate and various mixtures thereof;

(b) a product of the hydrolysis of said copolymer; or (c) a mixture of said copolymer and said product.

As used herein:

"GPC weight average molecular weight" means the weight average molecular weight determined by gel permeation chromatography (GPC) which is described in Chapter I of "Handbook of Size Exclusion Chromatography", Ed. Chi-san Wu, Marcel Dekker, 1995.

"Side" means one half of a full hide cut along the back bone from neck end to butt end.

"Tanned leather" means hides, such as, those from bovines; skins, such as, those from pig, sheep, deer and snake; and pelts from furry animals, such as, rabbits, mink, sable and otter, that have been subjected to chrome or other metal or vegetable tanning step. Chrome tanned leather is sometimes referred to, as wet blue stock or wet blue.

"Retanned leather" means tanned leather that has been subjected to retanning step.

"Crust leather" means retanned leather that has been dried and staked, i.e., mechanically softened.

"Float" means water added to the tanning drum before the start of retanning or other operations, such as, coloring and fatliquoring.

"Syntan" means a water-soluble copolymer, a water-dispersed copolymer, or a mixture thereof contained in a liquid medium. Water-dispersed copolymer means a dispersion of particles of a copolymer in the liquid medium. Water-soluble copolymer means a copolymer dissolved in the liquid medium. Further information is disclosed in an article entitled "*Physical Characterization of Water Dispersed and Soluble Acrylic Polymers*" by Brendley et al., and also in "Nonpolluting Coatings and Coating Processes" published by Plenum Press, 1973 and edited by Gordon and Prane.

"Polymer or copolymer solids" means polymer or copolymer in its dry state after removing the liquid medium.

The term "(meth)acrylate" includes acrylate and methacrylate.

"Copolymer" means a polymer prepared from two or more monomers.

The applicants have unexpectedly discovered that by incorporating a vinyl ester monomer, such as, vinyl acetate, in a syntan suitable for use in the method of the present invention, improved dyeing characteristics of the retanned leather can be achieved, while still retaining other desired properties, such as, grain break, grain crack and tongue tear. It is believed, without reliance thereon, that since a vinyl ester monomer as well as the product of hydrolysis of the vinyl ester monomer suitable for use in the present invention is neither basic or acidic, i.e., neutral, it does not block the dye sites on leather surface. Thus, more dye sites on which dye can attach, are made available. As a result, dye is uniformly distributed over the leather surface and a lesser amount of dye is required to achieve a same degree of dye expression that would result from using a greater amount of dye with conventional anionic acrylic syntans.

The first step of the method of the present invention includes contacting tanned leather with a syntan added to a float to produce a retanned leather having improved dyeing characteristics. Preferably the tanned leather is immersed, more preferably in a tumbler drum, which contains in the range of from 50 to 200 percent, preferably in the range of from 75 to 125 percent float maintained in range of from 25° C. to 60° C., preferably in the range of from 25° C. to 45° C., for 15 minutes to 3 hours, preferably for 30 minutes to an hour.

The liquid medium of the syntan includes in the range of from 15 weight percent to 75 weight percent, preferably in the range of from 20 weight percent to about 50 weight percent of syntan solids. The liquid medium may include water, a water miscible solvent, such as, methanol, ethanol and glycol ethers, or a solution of water and water miscible solvents. Water is preferred.

The amount of syntan added to the float varies from 0.25 parts by weight (pbw) to 10 pbw, preferably 0.5 pbw to 5.0 pbw, of the polymer per 100 pbw of the wet, tanned, wrung, shaved leather.

The pH of the float containing the syntan suitable for use in the method of the present invention may be adjusted over a wide range to allow a retanner latitude in varying process conditions during retanning, dyeing and fatliquoring process steps. The float pH in the method of the present invention may be varied in the range of from 3 to 6, preferably in the range from 4 to 5.5. Any conventional pH neutralizers may be employed to adjust the pH of the float. Some of the suitable pH neutralizers used for adjusting the float pH include alkali metal acetates, alkali metal bicarbonates, alkali metal formates, ammonium hydroxide, ammonium bicarbonate, borax and various combinations thereof. Sodium bicarbonate, sodium acetate or a combination of both is preferred. If the pH of the float drops below 3 no significant penetration of the syntan occurs. If the pH of the float exceeds 6, excessive swelling of the leather fibers occurs, which results in loss of grain break of the resulting retanned leather.

The copolymer suitable for use in the claimed method includes a water-soluble copolymer, water-dispersed copolymer or a mixture thereof. A syntan containing a water-soluble copolymer is preferred.

The copolymer has a weight average molecular weight, as determined by gel permeation chromatography, in the range of from 1,500 to 100,000, preferably in the range of from 2,000 to 90,000 and more preferably in the range of from 3,000 to 80,000. If the weight average molecular weight of the copolymer exceeds 100,000, the penetration of the syntan into the tanned leather is hindered and if the weight average molecular weight of the syntan polymer is less than 1,500 an insignificant degree of retanning of the tanned leather occurs.

The copolymer suitable for use in the claimed method is copolymerized from a monomer mixture, which includes at least one carboxylic acid monomer and at least one vinyl ester monomer. The monomer mixture includes in the range of from 5 percent to 90 percent, preferably in the range of from 5 percent to 80 percent and more preferably in the range of from 10 percent to 70 percent of the carboxylic acid monomer and in the range of from 95 percent to 10 percent, preferably in the range of from 95 percent to 20 percent and more preferably in the range of from 90 percent to 30 percent of the vinyl ester monomer, all in weight percentages based on the total weight of the monomer mixture. If the amount of acid monomers utilized in the monomer mixture is below 5 weight percent, an insignificant amount of retanning occurs and if the amount of acid monomers utilized in the monomer mixture exceeds 90 weight percent, no significant improvement in the dyeing characteristics would be seen over conventional acrylic syntans.

Some of the suitable of the carboxylic acid monomers include, for example, acrylic acid, acryloxypropionic acid, methacrylic acid, itaconic acid, crotonic acid, maleic acid, maleic anhydride, fumaric acid, half-esters of ethylenically unsaturated dicarboxylic acids, half-amides of ethylenically unsaturated dicarboxylic acids and various mixtures thereof.

The ethylenically unsaturated monocarboxylic acid monomers are preferred and acrylic acid is more preferred.

Other suitable carboxylic acid monomers include terminally unsaturated acrylic acid oligomers disclosed in a commonly assigned European patent application No. 953039419, laid open on December 20, 1995 (Publication No. 0687690) and entitled as "High Temperature Polymerization Process and Products Therefrom".

Suitable vinyl ester monomer include vinyl acetate, vinyl propionate, vinyl neononanoate, vinyl neodecanoate, vinyl-2-ethylhexanoate, vinyl pivalate, vinyl versatate or various mixtures thereof. Vinyl acetate, vinyl propionate and various mixtures thereof are preferred.

The monomer mixture may optionally include one or more copolymerizable ethylenically unsaturated comonomers. Such comonomers include olefins, ($C_1$–$C_{20}$) alkyl or hydroxy alkyl (meth)acrylate monomers, neutral monomers, vinyl monomers, crosslinkable monomers and various mixtures thereof.

Suitable alkyl or hydroxy alkyl (meth)acrylate comonomers include ($C_1$–$C_{20}$)alkyl (meth)acrylate monomers. As used herein the terminology "($C_1$–$C_{20}$)alkyl" denotes an alkyl substituent group having from 1 to 20 carbon atoms per group. Suitable ($C_1$–$C_{20}$)alkyl (meth)acrylate comonomers include, for example, acrylic and methacrylic ester monomers including methyl (meth)acrylate, ethyl (meth)acrylate, butyl (meth)acrylate, 2-ethylhexyl (meth)acrylate, decyl (meth)acrylate, lauryl (meth)acrylate, cetyl (meth)acrylate, eicosyl (meth)acrylate, isobornyl (meth)acrylate, isodecyl (meth)acrylate, oleyl (meth)acrylate, palmityl (meth) acrylate, stearyl (meth)acrylate, hydroxyethyl (meth) acrylate, and hydroxypropyl (meth)acrylate, or various mixtures thereof.

Suitable neutral comonomers include, for example, one or more monomers, such as, (meth)acrylonitrile, (meth) acrylamide, alkyl substituted (meth)acrylamide monomers or mixtures thereof.

Suitable vinyl monomers include, for example, one or more polymerizable vinyl aromatic compounds, such as, styrene; alkyl-substituted styrenes, such as, α-methylstyrene, α-ethylstyrene, p-methylstyrene and vinyl xylene; halogenated styrenes, such as, chlorostyrene, bromostyrene and dichlorostyrene, other styrenes having one or more nonreactive substituents on the benzene nucleus, vinyl naphthalene or various mixtures thereof.

Other suitable vinyl monomers include, for example, vinyl halide, preferably vinyl chloride, vinylidene halide, preferably vinylidene chloride, or various mixtures thereof.

Suitable multifunctional comonomers, used for crosslinking or building molecular weight, include allyl (meth) acrylate; acrylic and methacrylic esters of diols, triols, such as, ethylene di(meth)acrylate, 1,3-butylene di(meth) acrylate, 1,6-hexane di(meth)acrylate, trimethylolpropane triacrylate; divinyl benzene; dicyclopentadienyl (meth) acrylate; butadiene monomers; glycidyl (meth)acrylate; acetoacetoxyethyl (meth)acrylate; acrolein, methacrolein; isocyanoatoethyl methacrylate, dimethyl meta-isopropenyl benzyl isocyanate or various mixtures thereof.

The monomer mixture may further include other suitable comonomers, such as, monomethyl itaconate, monomethyl fumarate, monobutyl fumarate, acrylamido propane sulfonate, sodium vinyl sulfonate and phosphoethyl (meth) acrylate.

The polymerization techniques used for preparing the copolymer of the present invention are well known in the art. The copolymer may be prepared by emulsion or solution polymerization, preferably by free-radical initiation. The polymerization may be performed continuously or batchwise. Either thermal or redox initiation processes may be used.

The polymerization process is typically initiated by conventional free radical initiators, which include hydrogen peroxide; hydroperoxides, such as, t-butyl hydroperoxide; dialkyl peroxides, such as, di-t-butyl peroxide; peroxy esters, such as, t-butylperoxy pivalate; diacyl peroxides, such as, benzoyl peroxide; azo compounds, such as, 2-2'-azobisisobutyronitrile; and, ammonium and alkali persulfates, such as, sodium persulfate, typically at a level of 0.05 percent to 3.0 percent by weight, all weight percentages based on the total weight of the monomer mixture. Redox systems using the same initiators coupled with a suitable reductant such as, for example, sodium bisulfite, sodium hydrosulfite, sodium formaldehyde sulfoxylate and ascorbic acid, may be used at similar levels.

The free-radical initiated solution polymerization is preferably carried out in the presence of inert solvents, including water or organic solvents, such as, toluene, xylene, ethylbenzene, aliphatic hydrocarbons, or naphtha fractions, which contain no polymerizable monomers. Other suitable inert solvents include chlorinated hydrocarbons, such as, chloroform, carbon tetrachloride, hexachloroethane and tetrachloroethane; water miscible solvents, such as, acetic acid, ethanol, isopropanol, t-butanol; and glycol ethers, such as, ethylene glycol monobutyl ethers, propylene glycol and monopropyl ether. Water and water miscible solvents are preferred. Water is more preferred.

Chain transfer agents may be used in an amount effective to provide the desired GPC weight average molecular weight. For the purposes of regulating molecular weight of the copolymer being formed, suitable chain transfer agents include well known halo-organic compounds, such as, carbon tetrabromide and dibromodichloromethane; sulfur-containing compounds, such as, alkylthiols including ethanethiol, butanethiol, tert-butyl and ethyl mercaptoacetate, as well as aromatic thiols; or various other organic compounds having hydrogen atoms which are readily abstracted by free radicals during polymerization. Additional suitable chain transfer agents or ingredients include but are not limited to butyl mercaptopropionate; isooctylmercapto propionate; bromoform; bromotrichloromethane; carbon tetrachloride; alkyl mercaptans, such as, 1-dodecanthiol, tertiary-dodecyl mercaptan, octyl mercaptan, tetradecyl mercaptan, and hexadecyl mercaptan; alkyl thioglycolates, such as, butyl thioglycolate, isooctyl thioglycoate, and dodecyl thioglycolate; thioesters; or combinations thereof. Mercaptans are preferred.

If desired, a product of the hydrolysis of the copolymer or a mixture of the copolymer and the hydrolysis product may be included in the syntan suitable for use in the present invention. The product of hydrolysis of the copolymer may be obtained by contacting the copolymer with an acid or a base to achieve a degree of hydrolysis varying in the range of from 0 percent to 100 percent, preferably in the range of from 0 to 80 percent. Some of the bases suitable for hydrolysis of the copolymer include an alkali metal hydroxide, such as, sodium hydroxide; an alkali metal alkoxide, such as, sodium methoxyide, ammonium hydroxide, or various combinations thereof. Some of the acids suitable for hydrolysis of the copolymer include inorganic acids, such as, hydrochloric acid and sulfuric acid; and organic acids, such as, acetic acid and formic acid. Bases are preferred. Alkali metal hydroxides are more preferred and sodium hydroxide is most preferred.

The syntan may be added to the float before, simultaneously with or after one or more colorants. The colorants are added to the float to impart the desired color to the tanned leather. Typically one or more colorants in the range of from 0.5 percent to 7.5 percent per 100 percent of the weight of wet tanned, wrung, shaved leather are added. Any conventional colorants may be employed in the method of the present invention, for example, anionic dyes, such as, Derma® Blue R 67, Derma® Green BS and Derma® Grey LL or anionic metal complex dyes, such as, Sandoderm® Yellow R, Sandoderm® Brown G, all of which are supplied by Sandoz Chemical Corporation, Charlotte, N.C.

If desired, the float further contains one or more conventional fatliquors for improving the strength and temper of the retanned leather.

EXAMPLES

The following Examples are presented to illustrate further various aspects of the present invention, but are not intended to limit the scope of the invention in any respect.

Preparation of Syntans

The abbreviations listed below are used throughout the preparation procedure of Syntans described below:

AA=acrylic acid

AM=acrylamide

AN=acrylonitrile

MAN=maleic anhydride

MPA=3-mercaptopropionic acid

VAc=vinyl acetate

VOH=vinyl alcohol

VPr=vinyl propionate

Characterizations of copolymers in the following preparations were determined as follows:

Solids content was determined gravimetrically by drying a sample of Syntan for 1 hour at 150° C. in a forced draft oven.

The pH was determined using a standard pH meter calibrated on pH 4 and pH 7 buffers.

The acid number was determined by potentiometric titration of an aliquot of polymer solution in deionized water by adjusting the sample to pH 2.5 and then titrating upscale with 0.5N NaOH with a TTT 80 automatic titrator with an ABU 80 autoburrette from Radiometer America inc., Westlake, Ohio 44145. The acid number was calculated based on the mg of KOH required to neutralize 1.0 g of polymer solids between the inflection points, which occur at approximately pH 3.5 and pH 9.5.

The molecular weight was determined using gel permeation chromatography (GPC) and was reported as the weight average molecular weight. Samples were prepared for GPC by hydrolysis in 10% ethanolic KOH to the poly(acid-VOH) backbone and compared to pAA standards. The results were corrected to account for weight loss due to hydrolysis.

Syntan 1

The polymerization was carried out under a nitrogen atmosphere in a 2-liter, four-neck, round-bottom glass flask equipped with a mechanical blade stirrer, a thermocouple to monitor temperature, a reflux condenser, and a means to heat and cool. The flask was charged with 445 g of deionized water, 0.01 g of iron sulfate heptahydrate, and 0.1 g of sodium bisulfite and heated to 70° C. A monomer mixture of 175 g AA and 75 g VAc, 0.5 g of sodium persulfate dissolved in 65 g of deionized water, 1.2 g of sodium bisulfite in 65 g of deionized water, and 14.6 g of sodium hydroxide pellets dissolved in 130 g of deionized water were fed evenly over 2 hours while maintaining the temperature at 70° C. Feed lines to the flask were rinsed with 45 g of deionized water and an additional 100 g of deionized water was added to reduce the viscosity. An additional 0.25 g of sodium persulfate was added and the temperature was maintained at 70° C. for 30 minutes before cooling. The resulting viscous, hazy polymer solution (70 AA/30 VAc Syntan) had a solids content of 18.4%, a pH of 4.5, an acid number of 625 and a weight average molecular weight of 54,000.

Syntan 2

The polymerization was carried out under a nitrogen atmosphere in a 2-liter, four-neck, round-bottom glass flask equipped with a mechanical blade stirrer, a thermocouple to monitor temperature, a reflux condenser, and a means to heat and cool. The flask was charged with 325 g of isopropanol, 25.5 g of a monomer mixture prepared from 175 g AA and 75 g vinyl acetate, 4.5 g of a solution prepared from 44 g isopropanol and 2.5 g t-butyl peroctoate, and heated to 82° C. The remaining monomer mixture and t-butyl peroctoate solution were added evenly over 2.5 hours while maintaining the temperature at 82° C. Then 15 g of isopropanol was used to rinse the feed lines used for supplying the monomer mixture to the flask. An additional 2.5 g of t-butyl peroctoate were added and the reaction was held at reflux for 1 hour. After cooling slightly, 400 g of deionized water was added and the flask was fitted with a distillation head for stripping off solvent. The isopropanol was removed by maintaining the reaction at reflux until the temperature reached 95° C. A total of 398 g of solvent was removed. After cooling the reaction mixture to 60° C., 48.6 g of NaOH pellets dissolved in 344 g of deionized water were added and the reaction mixture was cooled to room temperature. The resulting slightly hazy polymer solution (70 AA/30 VAc Syntan) had a solids content of 25.8%, a pH of 5.0, an acid number of 480 and a weight average molecular weight of 4900.

Syntan 3

The procedure for preparing Syntan 2 was followed except that the monomer mixture was prepared from 187.5 g AA and 62.5 g VPr, and 48.6 g of NaOH pellets dissolved in 344 g of deionized water were added after stripping 413 g of solvent. The resulting hazy polymer solution (75 AA/25 VPr Syntan) had a solids content of 26.5%, a pH of 5.0, an acid number of 490 and a weight average molecular weight of 5100.

Syntan 4

The procedure for preparing Syntan 2 was followed except the monomer mixture included 150 g AA, 100 g VAc and 5 g of MPA, and only half the reaction mixture (324.5 g) was taken for solvent exchange with 200 g of deionized water. After 123 g of solvent was removed, 20.8 g NaOH pellets dissolved in 167 g of deionized water were added and the reaction mixture was cooled. The resulting hazy, yellow polymer solution (60 AA/40 VAc Syntan) had a solids content of 22.0%, a pH of 5.5, an acid number of 400 and a weight average molecular weight of 3900.

Syntan 5

The procedure for preparing Syntan 4 was followed except that the monomer mixture was prepared from 200g AA, 50 g VAc and 5 g MPA. After 180 g of solvent was removed, and 27.8 g of NaOH pellets dissolved in 167 g of deionized water were added. The resulting slightly hazy polymer solution (80 AA/20 VAc Syntan) had a solids content of 25.8%, a pH of 5.3, an acid number of 510 and a weight average molecular weight of 3400.

Syntan 6

The procedure for preparing Syntan 2 was followed except that the monomer mixture was prepared from 50 g AA and 200 g VAc, and 19.5 g of NaOH pellets dissolved in 334 g of deionized water were added after stripping 388 g solvent. The resulting hazy polymer solution (20 AA/80 VAc Syntan) contained a large amount of redispersible sediment, and after vigorous agitation had a solids content of 23.1%, a pH of 5.7, an acid number of 170 and a weight average molecular weight of 3100.

Syntan 7

The procedure for preparing Syntan 2 was followed except that the monomer mixture was prepared from 125 g AA, 125 g VAc and 5 g MPA, and 34.7 g of NaOH pellets dissolved in 344 g of deionized water were added after stripping 404 g of solvent. The resulting hazy polymer solution (50 AA/50 VAc Syntan) contained a small amount of redispersible sediment, and after vigorous agitation had a solids content of 27.6%, a pH of 5.1, an acid number of 340 and a weight average molecular weight of 3100.

Syntan 8

The procedure for preparing Syntan 2 was followed except that the monomer mixture was prepared from 100 g AA, 150 g VAc and 5 g MPA, and 27.8 g of NaOH pellets dissolved in 344 g deionized water were added after stripping 398 g of solvent. The resulting hazy polymer solution (40 AA/60 VAc Syntan) contained redispersible sediment, and after vigorous agitation had a solids content of 26.3%, a pH of 5.1, an acid number of 310 and a weight average molecular weight of 3000.

Syntan 9

The polymerization was carried out under a nitrogen atmosphere in a 2-liter, four-neck, round-bottom glass flask equipped with a mechanical blade stirrer, a thermocouple to monitor temperature, a reflux condenser, and a means to heat and cool. The flask was charged with 250 g xylene and 11 g MAN and heated to 80° C. Ten grams of a solution of 2 g of 75% active tert-butyl peroxypivalate in 30 g xylene was added to the flask, followed by the even addition of a solution of 55 g VAc, 43 g MAN and 250 g xylene over 3 hours. During the monomer addition, 2 g of the tert-butyl peroxypivalate solution was added every 15 minutes while maintaining the temperature at 80° C. An additional 0.5 g tert-butyl peroxypivalate in 5 g xylene was added and the temperature maintained at 80° C. for 1 hour before cooling to room temperature. After cooling, 305 g deionized water and 48.4 g of 50% aqueous NaOH were added to the reaction flask. The contents were stirred and heated to 60° C. for one hour to extract the precipitated polymer solids from the xylene into the aqueous layer. After cooling, the layers were separated. The resulting hazy yellow polymer solution (50 MAN/50 VAc Syntan) had a solids content of 24.9%, a pH of 5.0 and an acid number of 440. Weight average molecular weight was not determined.

Syntan 10

A continuous process polymerization was run in a 12 foot long section of stainless steel tubing having an inner diameter of 1.59 mm and a wall thickness of 1.27 mm, which was connected at one end to a high pressure pump (Hewlett Packard Model HP 1050 TI) and at the other end to a back-pressure control device. Between the two ends, the section of tubing was coiled about a torus-shaped metal mandrel. The mandrel was situated above a primary coil of a transformer so that the coils of stainless steel tubing and the mandrel functioned as secondary coils of the transformer. The coils of stainless steel tubing were further equipped with one end of a temperature probe. The other end of the temperature probe was connected to a temperature controlling device, which regulated the current supplied to the primary coils of the transformer. By this means, the heat of inductance imparted to the coiled stainless steel tubing was regulated. Beyond the coiled, heated section of the tubing was a heat exchanger cooled by a water stream, which cooled the reaction product to room temperature before the pressure is let down. The details of the aforedescribed device are disclosed in a commonly assigned European patent application No. 953039419, laid open on Dec. 20, 1995 (Publication No. 0687690) and entitled as "High Temperature Polymerization Process and Products Therefrom".

A reaction mixture was prepared from 500 g glacial acetic acid, 250 g AA, 250 g VAc and 20 g of 70% hydrogen peroxide. Nitrogen was bubbled through the mixture while stirring. Deionized water was pumped through the stainless steel tubing at a rate of about 5 milliliters per minute, to equilibrate the reactor to a pressure of about 300 kilograms per square centimeter and a temperature of 200° C. After 15 minutes, the water was replaced by the reaction mixture and the flow rate was adjusted to provide a residence time of 56 seconds. After waiting 15 minutes for this new feed to equilibrate through the reactor system, the product was collected as the effluent from the pressure control device. When the reaction mixture was nearly gone, deionized water was pumped through the tubing at the same rate, pressure and temperature as the reaction mixture. The percent product solids of the collected crude effluent was 43.6%. The solids were isolated by vacuum stripping and analysis by NMR showed a 2:1 molar ratio of AA:VAc in the copolymer.

A 500 ml, four-neck, round bottom glass flask equipped with a mechanical blade stirrer, a thermocouple to monitor temperature, a reflux condenser, and a means to heat and cool was charged with 50 g of the aforedescribed vacuum stripped solid copolymer and 82 g deionized water. A solution of 7.6 g NaOH pellets dissolved in 68.4 g of deionized water was added to the flask causing the temperature to rise 15° C. The mixture was stirred for 2 hours with cooling back to room temperature. The resulting hazy, brownish solution (63 AA/37 VAc Syntan) had a solids content of 22.3%, a pH of 5.1, an acid number of 480 and a weight average molecular weight of 4200.

Syntan 11

A 500 ml, four-neck, round bottom glass flask equipped with a mechanical blade stirrer, a thermocouple to monitor temperature, a reflux condenser, and a means to heat and cool was charged with 50 g of the vacuum stripped solid copolymer described in the preparation of Syntan 10 and 75 g deionized water. A solution of 27 g of NaOH pellets in 148 g of deionized water was added in three parts while the reaction mixture was heated at 60° C. for a total of 6 hours. An additional 20 g of deionized water was used to rinse the NaOH solution to the reaction flask the reaction mixture was cooled. The pH was then adjusted at room temperature with 9.3 g of 90% formic acid dissolved in 27 g of deionized water. The resulting amber polymer solution (77 AA/23 VOH Syntan) had a solids content of 21.2%, a pH of 5.9, an acid number of 430 and a weight average molecular weight of 3350.

Syntan 12

The polymerization was carried out under a nitrogen atmosphere in a 2-liter, four-neck, round-bottom glass flask equipped with a mechanical blade stirrer, a thermocouple to monitor temperature, a reflux condenser, and a means to heat and cool. The flask was charged with 445 g of deionized water, heated to 87° C. and a solution of 2.2 g of sodium persulfate in 20 g deionized water was added. A mixture of 175 g AA and 75 g VAc, 6.6 g of sodium persulfate in 130 g deionized water and 14.6 g of NaOH pellets dissolved in 130 g of deionized water were fed evenly over three hours while maintaining the temperature at 85° C. A total of 15 g of deionized water was used to rinse the feed lines to the flask. An additional 0.25 g of sodium persulfate dissolved in 15 g deionized water was added and the temperature was raised to 93° C. and kept there for 30 minutes before cooling. The resulting clear yellow polymer solution (70 AA/30 VAc Syntan) had a solids content of 24.2%, a pH of 3.7, an acid number of 540 and a weight average molecular weight of 7,700.

Syntan 13

The procedure for preparing Syntan 2 was followed except that the monomer mixture was prepared from 175 g AA, 50 g VAc, 25 g AN and 5 g MPA, and 48.6 g of NaOH pellets dissolved in 344 g of deionized water were added after stripping 362 g of solvent from the reaction mixture. The resulting slightly hazy, yellow polymer solution (70 AA/20 VAc/10 AN Syntan) had a solids content of 25.6%, a pH of 5.0, an acid number of 480 and a weight average molecular weight of 5000.

Syntan 14

The procedure for preparing Syntan 2 was followed except that the monomer mixture was prepared from 175 g AA, 62.5 g VAc, 12.5 g AM and 5 g MPA, and 48.6 g of NaOH pellets dissolved in 344 g of deionized water were added after stripping 295 g of solvent from the reaction mixture. The resulting slightly hazy polymer solution (70 AA/25 VAc/5 AM Syntan) had a solids content of 26.1%, a pH of 5.0, an acid number of 480 and a weight average molecular weight of 4100.

Comparative Syntan A

Comparative Syntan A was a commercially available anionic acrylic syntan, known as Relugan® RE, supplied by BASF Corporation, Parsippany, N.J. 07054.

Comparative Syntan B

Comparative Syntan B was a commercially available anionic acrylic syntan, known as Leukotan® 1084, supplied by the Rohm and Haas Company, Philadelphia, Pa. 19106.

Comparative Syntan C

Comparative Syntan C was a commercially available anionic acrylic syntan, known as Leukotan® 974, supplied by the Rohm and Haas Company, Philadelphia, Pa. 19106.

Comparative Syntan D

Comparative Syntan D was a commercially available anionic acrylic 20 syntan, Paramel® PA, supplied by Yorkshire Nachem, Inc., Peabody, Mass. 01960.

Treatment of Leather

All retanned leathers were prepared from either lightweight (thickness varying in the range of from 1.0 to 1.4 mm) or heavyweight (thickness varying in the range of from 1.9 to 2.3 mm) shaved wet blue, chrome tanned bovine leather. The retanning step was conducted in matched tanning drums manufactured by Dose Maschinenbau Gmbh, which were specifically designed for wet-end leather procedures. These heated, rotating, stainless steel drums had a volume of about 400 liters.

All the weights used during the retanning or any subsequent steps, such as, coloring and fatliquoring steps, were based on the relative weight of the wet, wrung, shaved blue stock (chrome tanned leather) in a tanning drum. For example, a 100 percent float was a weight of float equal to the weight of the wet blue hide and a 200 percent float was a weight of float equal to twice the weight of the wet blue hide being retanned.

Evaluation of Treated Leather

The retanned leather strips were evaluated for their physical characteristics, aesthetics and color under the procedures described below. The evaluation results of leather strips from each leather side were reported as a group to eliminate the effect of naturally occurring variations from one leather side to the next. At least one Comparative Syntan was included in evaluating each side.

Tongue Tear Test

The crust leather's strength was measured by a tensile strength tester similar to that used for conducting the Standard Test Method for Tearing Strength, Tongue Tear of Leather, ASTM D4704-93. The sole exception was that the leather sample did not have a 4.76 mm hole located on the long axis 25.4 mm from one end. The Tongue Tear test involved cutting the test specimen and then pulling the two tongues apart. The tear strength was reported in Newtons (N). The tongue tear strength for a piece of upholstery leather, such as the light weight leather used in Examples 22 to 24, was measured against a scale in which a value of 20 Newtons is considered to be acceptable and a value of 30 Newtons is considered to be excellent.

Color Evaluation

The dyeing characteristics were evaluated by using the UltraScan XE spectrocolorimeter manufactured by Hunter Associates Laboratory Inc., Reston, Va. 22090. In accordance with the test method, as described in "Colorimetry and the Calculation of Color Difference" by Ralph Stanziula, Industrial Color Technology, Neshanic Station, N.J. 08853, the reported value is the average color shift, AE, as compared against a control, in this case the color of the stock strips from the same side of leather treated with the Comparative Syntan. A higher positive AE indicates a deeper dye shade relative to control. A difference in AE greater than 0.4 is perceivable to the human eye.

Grain Break Test

Grain Break was evaluated by visual inspection (observation) of the treated leather as it is hand flexed or bent. The break is rated using SATRA Method PM36. The SATRA Scale is a method developed by SATRA Footwear Technology Center, Kettering, Northants, England. In this method, the leather is rated from 1 to 8, with lower values considered better than higher values. A SATRA value of less than or equal to 3 is considered acceptable.

Grain Crack Strength

Grain Crack Strength was evaluated according to SATRA Test Method PM 24. In this method the force required for a probe to cause the leather grain to crack when applied from the flesh side is recorded. This force is divided by the thickness of the leather at the point of force. The results was reported in kilograms per millimeter. The SATRA Lastometer used to measure the grain crack strength was supplied by SATRA House, Rockingham Road, Kettering, Nothants, NN16 9JH, England.

Retan Procedure for Examples 1–21 Obtained from Sides 1–5

1. A shaved wet blue, chrome-tanned, 2.0 mm bovine side was cut from backbone to belly into several strips, which were tumbled for 5 minutes with water continually flowing through the tanning drum at 35° C. After 5 minutes, the water was drained from the tanning drum.

2. Sodium acetate (1.0%) plus 1.0% sodium bicarbonate were added to 100 percent fresh float maintained at 35° C. The stock was neutralized for 60 minutes to a float pH of 5.0 to 5.1. After 60 minutes, the float was drained from the tanning drum.

3. The neutralized stock was then washed in the tanning drum for another 10 minutes at 27° C. After 10 minutes the water was drained. After draining, the strips were separated and placed in individual drums for application of the syntans, dyeing and fatliquoring.

4. The same procedure was used for strips obtained from different leather sides (total of five different leather sides, marked as Side 1 through Side 5). Stock strips for each example from these various sides were kept segregated throughout the retanning, dyeing and fatliquoring by processing them in individual tanning drums. Stock strips were identified as Example 1 though 21, listed in Table I below.

In separate tanning drums, the stock strips were retanned for 40 minutes with a 100 percent float maintained at 27° C. with 2.0 weight percent solids of the various syntans described in Table I below. The stock strips were then dyed with 1.0 weight percent of various acid dyes, described below along with an additional 50 percent float maintained at 27° C. for 30 minutes. Sides 1 and 3 received Leather Brown Gr dye supplied by Keystone Aniline Corp. Chicago, Ill. 60612. Side 2 received Derma® Havana R dye supplied by Sandoz Chemicals Corp., Charlotte, N.C. 28205. Sides 4 and 5 received Xylene Green B dye supplied by Sandoz Chemicals. All of the retanned and dyed stock strips were then "fixed" or acidified by adjusting the pH of the float to less than 4.2 with 1.0 weight percent formic acid added to the float and run for 10 minutes. After 10 minutes, the float was drained.

6. The retanned, dyed and fixed stock was washed 5 minutes with water at 50° C. continually running through the drum. After 5 minutes, the residual water was drained.

7. The retanned stock strips were then fatliquored for 60 minutes with a 100 percent float at 50° C. containing 6 weight percent (product as solid by supplier) based on the blue stock weight of Morite® G-82 (a blend of 67 percent natural and 33 percent synthetic fatliquors with 2.5 percent combined $SO_3$ (sulfonate content) from Whittemore-Wright Co., Boston, Massachusetts) and then fixed with 10 percent formic acid to a pH less than 4.2. Stock strips identified as Examples 9 through 14 used 6 percent Texol® R in place of the Morite G-82. Texol® R is a blend of coconut, synthetic, sperm and neatsfoot oil with 3.7% combined sulfate, available from Salem Oil and Grease Co., Salem, Mass.

8. The fatliquored and retanned stock strips were hauled, horsed overnight, set out by hand, vacuum dried for 1 minute at 70° C., aired off overnight at room temperature, and then staked before evaluation Examples On Side 1

Stock strips from Side 1, identified as Examples 1, 2, 3 and 4 were treated with Comparative Syntan A, Syntan 1, Syntan 2 and Syntan 3, respectively. Side 1 was a single side of a 2.0 mm, chrome-tanned wet blue. The evaluation results, shown in Table I, illustrate the unexpected discovery that the syntans in Examples 2 through 4 impart a deeper dye shade than the Comparative Syntan A from Example 1, while still retaining other critical properties, such as, grain break and grain crack strength.

Examples On Side 2

Stock strips from Side 2, identified as Examples 5, 6, 7 and 8 were treated with Comparative Syntan B, Comparative Syntan C, Syntan 4 and Syntan 5, respectively. Side 2 was a single side of a 2.0 mm, chrome-tanned vet blue. The evaluation results, shown in Table I, illustrate the unexpected discovery that the syntans in Examples 7 and 8 impart a deeper dye shade than the Comparative Syntans B and C from Examples 5 and 6, while still retaining other critical properties, such as, grain break and grain crack strength.

Examples On Side 3

Stock strips from Side 3, identified as Examples 9, 10, 11, 12, 13 and 14 were treated with Comparative Syntan D, Comparative Syntan A, Syntan 6, Syntan 7, Syntan 8 and Syntan 9, respectively. Side 3 was a single side of a 2.0 mm, chrome-tanned wet blue. The evaluation results, shown in Table I, illustrate the unexpected discovery that the syntans in Examples 11 through 14 impart a deeper dye shade than Comparative Syntans D and A from Examples 9 and 10, while still retaining other critical properties, such as, grain break and grain crack strength.

Examples On Side 4

Stock strips from Side 4, identified as Examples 15, 16 and 17 were treated with Comparative Syntan B, Syntan 10 and Syntan 11, respectively. Side 4 was a single side of a 2.0 mm, chrome-tanned wet blue. The evaluation results, shown in Table I, illustrate the unexpected discovery that the syntans in Examples 16 and 17 impart a deeper dye shade the Comparative Syntan B from Example 15, while still retaining other critical properties, such as, grain break and grain crack strength.

Examples On Side 5

Stock strips from Side 5, identified as Examples 18, 19, 20 and 21 were treated with Comparative Syntan B, Syntan 12, Syntan 13 and Syntan 14, respectively. Side 5 was a single side of a 2.0 mm, chrome-tanned wet blue. The evaluation results, shown in Table I, illustrate the unexpected discovery that the syntans in Examples 19 through 21 impart a deeper dye shade than from Comparative Syntan B from Example 18, while still retaining other critical properties, such as, grain break and grain crack strength.

TABLE I

| Side | Example | Syntan | Break (Satra) | Grain Crack* | Color (ΔE) |
|---|---|---|---|---|---|
| 1 | 1 | Comp. A | 2.0 | 19.2 | Control |
| 1 | 2 | 1 | 2.0 | 16.3 | 6.33 |
| 1 | 3 | 2 | 2.8 | 28.7 | 5.33 |
| 1 | 4 | 3 | 2.5 | 25.3 | 3.78 |
| 2 | 5 | Comp. B | 2.0 | 26.0 | Control |
| 2 | 6 | Comp. C | 1.6 | 35.3 | 4.36 |
| 2 | 7 | 4 | 2.2 | 30.1 | 7.66 |
| 2 | 8 | 5 | 2.5 | 34.6 | 4.99 |
| 3 | 9 | Comp. D | 2.5 | 19.7 | Control |
| 3 | 10 | Comp. A | 2.8 | 14.2 | 3.39 |
| 3 | 11 | 6 | 3.0 | 25.8 | 5.45 |
| 3 | 12 | 7 | 2.5 | 22.5 | 6.32 |
| 3 | 13 | 8 | 2.8 | 20.3 | 4.30 |
| 3 | 14 | 9 | 2.7 | 23.6 | 7.26 |
| 4 | 15 | Comp. B | 4.0 | 24.2 | Control |
| 4 | 16 | 10 | 2.0 | 30.2 | 9.74 |
| 4 | 17 | 11 | 3.0 | 31.0 | 5.23 |
| 5 | 18 | Comp. B | 3.1 | 21.3 | Control |
| 5 | 19 | 12 | 2.4 | 27.7 | 2.59 |
| 5 | 20 | 13 | 2.3 | 26.4 | 6.42 |
| 5 | 21 | 14 | 2.2 | 28.8 | 7.11 |

*measured in kilograms per millimeter of crust leather thickness

Retan Procedure for Example 22–24 Obtained from Side 6

1. A shaved wet blue, chrome-tanned, bovine side having a thickness varying from 1.0–1.4 mm was cut from backbone to belly into nine strips. Three strips, one from the neck area, one the middle area and one from the butt area, were used in each example. The strips were identified as Examples 22, 23 and 24 for application of Syntan 12, Comparative Syntan A or no syntan, respectively . All nine strips were tumbled for 5 minutes with water continually flowing through the tanning drum at 35° C. After 5 minutes, the water was drained from the tanning drum.

2. Sodium formate at 1 weight percent based on the blue side weight was added to 100 percent fresh float added to the tanning drum maintained at 35° C. The stock strips were neutralized for 30 minutes and the pH of the float was adjusted to 5.0 with sodium bicarbonate. After 60 minutes, the float was drained from the tanning drum.

3. The neutralized stock strips were then washed in the tanning drum for 10 minutes with water continually flowing through the drum at 40° C. After 10 minutes, the water was drained from the tanning drum and the stock strips were separated, identified as Examples 22, 23 and 24 and placed into individual drums (3 per drum) for further processing.

4. The stock strips of Examples 22, 23 and 24 were fatliquored for 15 minutes with 50 percent float at 40° C. containing 3 weight percent (product as sold by supplier) based on the blue side weight of Eureka® 800 R [a natural fatliquor with 1.7–2.0 percent combined $SO_3$ (sulfonate content) from Atlas Refinery Inc., Newark, N.J. 07105].

5. The stock strips of Examples 22, 23 and 24 were retanned for 15 minutes with 20 percent float at 40° C. with a 1.6 weight percent solids offer of Comparative Syntan A, no syntan and Syntan 12, respectively. The stock strips of Examples 22, 23 and 24 were then dyed with 2 weight percent of Vitrolan® Yellow GR dye (product as supplied by Sandoz Chemicals Corporation, Charlotte, N.C. 28205) for 40 minutes.

6. The stock strips of Examples 22, 23 and 24 were then retanned and lubricated with 12 weight percent product of Lubritan® SP (an acrylic lubricating syntan supplied by Rohm and Haas Co., Philadelphia, Pa. 19106) for 60 minutes with 50 percent float at 25° C.

7. The pH of the float was adjusted to less than 4.0 with 0.5% formic acid to acidify the stock strips of Examples 22, 23 and 24. After 10 minutes, the float was drained from the tanning drum.

8. The fixed, retanned and fatliquored stock strips of Examples 22, 23 and 24 were washed for 5 minutes with water at 40° C. continually flowing through the drum. After 5 minutes, the residual water was drained from the tanning drum.

9. The washed stock strips of Examples 22, 23 and 24 were then hauled, horsed overnight, set out by hand, vacuum dried for 1 minute at 70° C., aired off overnight at room temperature, and then staked before evaluation.

Examples on Side 6

The results of testing of the physical properties of the stock strips of Examples 22, 23 and 24 made on Side 6 are shown in Table II, below. Example 24 prepared with Syntan 12 had a deeper dye shade than Examples 22 or 23 produced either with Comparative Syntan A or with no syntan added before the dyeing in Step 5 above. In addition, Example 24 prepared with Syntan 12 exhibited a marked increase in tear strength relative to Examples 22 or 23, while still retaining other critical properties, such as, grain break and grain crack strength.

TABLE II

| Side | Example | Syntan | Break (Satra) | Grain Crack* | Color (ΔE) | Tear (N) |
|---|---|---|---|---|---|---|
| 6 | 22 | Comp. A | 2.0 | 8.8 | 0.91 | 21 |
| 6 | 23 | None | 2.0 | 10.7 | — | 22 |
| 6 | 24 | 12 | 2.3 | 10.5 | 1.70 | 26 |

*measured in kilograms per millimeter of crust leather thickness

What is claimed is:

1. A method of treating a tanned leather comprising:

retanning said tanned leather with a syntan to produce a retanned leather having improved dyeing characteristics, said syntan comprising:

(a) a copolymer polymerized by free-radical thermally initiated polymerization carried out at a temperature of 80°–200° C. from a monomer mixture comprising a carboxylic acid monomer and a vinyl ester monomer selected from the group consisting of vinyl acetate, vinyl propionate and mixtures thereof;

(b) a product of the hydrolysis of said copolymer; or (c) a mixture of said copolymer and said product.

2. The method of claim 1 wherein said monomer mixture comprises in the range of from 5 percent to 90 percent of said carboxylic acid and in the range of from 95 percent to 10 percent of said vinyl ester monomer, all in weight percentages based on the total weight of the monomer mixture.

3. The method of claim 1 wherein said carboxylic acid monomer is a monocarboxylic acid, a dicarboxylic acid or an anhydride thereof or mixtures thereof.

4. The method of claim 1 wherein said carboxylic acid monomer is selected from the group consisting of acrylic acid, methacrylic acid, itaconic acid, maleic acid, maleic anhydride, fumaric acid, and crotonic acid and mixtures thereof.

5. The method of claim 1 wherein said hydrolyzed product results from contacting said copolymer with an acid or a base to achieve a degree of hydrolysis varying in the range of from 0 percent to 100 percent.

6. The method of claim 5 wherein, said base is selected from the group consisting of an alkali metal hydroxide, and alkali metal alkoxide, ammonium hydroxide, and mixtures thereof.

7. The method of claim 1 wherein said copolymer has a GPC weight average molecular weight in the range of from 1500 to 100,000.

8. The method of claim 1 wherein said copolymer is a water-soluble copolymer, a water-dispersed copolymer, or a mixture thereof.

9. The method of claim 1 wherein said system is added to a retanning float before, after or simultaneously with a colorant, a fatliquor, a conventional retanning agent, or combinations thereof.

10. The method of claim 1 wherein said polymerization is carried out at 200° C. under pressure of about 300 kilograms per square centimeter.

11. The method of claim 1 wherein said polymerization is thermally intiated by a conventional free radical intiator selected from the group consisting of hydrogen peroxide, hydroperoxide, dialkyl peroxide, peroxy ester, diacryl peroxide, azo compound, and ammonium and alkali persulfates.

12. The method of claim 11 wherein the amount of said conventional free radical intiator used during said polymerization is in the range of 0.05 percent to 3.0 percent by weight, all weight percentages based on the total weight of the monomer mixtures.

13. The method of claim 1 wherein a chain transfer agent is added during said polymerization to provide said copolymer with a GPC weight.

14. A retanned leather having improved dyeing characteristics prepared in accordance with the method of claim 1.

15. A method of treating a tanned leather comprising:

retanning said tanned leather with a system to produce a retanned leather having improved dyeing characteristics, said system comprising:

(a) a product of the hydrolysis of a copolymer polymerized by free-radical initiated polymerization from a monomer mixture comprising a carboxylic acid monomer and a vinyl ester monomer selected from the group consisting of vinyl acetate, vinyl propionate and mixtures thereof; or (b) a mixture of said copolymer and said product.

16. The method of claim 15 wherein said polymerization is thermally intiated by a conventional free radical intiator selected from the group consisting of hydrogen peroxide, hydroperoxide, dialkyl peroxide, peroxy ester, diacyl peroxide, azo compound, and ammonium and alkali persulfates.

17. A retanned leather having improved dyeing characteristics prepared in accordance with the method of claim 15.

* * * * *

UNITED STATES PATENT AND TRADEMARK OFFICE

CERTIFICATE OF CORRECTION

PATENT NO. : 5,820,633

DATED : October 13, 1998

INVENTOR(S) : Patricia Marie Lesko, James John Hodder and Alvin Michael Maurice

It is certified that error appears in the above-identified patent and that said Letters Patent is hereby corrected as shown below:

On the title page, item [54] and column 1, line 2, "RETAINING" should be --RETANNING--

Column 12, line 52, 55 and 56: "AE" should be - - ΔE --

Signed and Sealed this

Nineteenth Day of January, 1999

*Attest:*

*Attesting Officer*

*Acting Commissioner of Patents and Trademarks*